United States Patent [19]

Schlesinger

[11] Patent Number: 4,830,370

[45] Date of Patent: May 16, 1989

[54] GAME BALL

[76] Inventor: Robert M. Schlesinger, 4 Franklin Sq., Dedham, Mass. 02026

[21] Appl. No.: 135,822

[22] Filed: Dec. 21, 1987

[51] Int. Cl.[4] ..... A63B 39/00

[52] U.S. Cl. ..... 273/61 R; 273/418

[58] Field of Search ..... 273/213, 186 D, 183 C, 273/418, 61 R, 29 A, 58 F, 58 H, 58 B, 58 BA, 61 A, 61 D

[56] References Cited

U.S. PATENT DOCUMENTS

| | | | |
|---|---|---|---|
| 3,081,091 | 3/1963 | Grow | 273/186 D |
| 4,065,126 | 12/1977 | Mantz | 273/186 D |
| 4,614,340 | 9/1986 | Hosoya | 273/213 |
| 4,637,616 | 1/1987 | Whiting | 273/186 D |

*Primary Examiner*—George J. Marlo

*Attorney, Agent, or Firm*—Nutter, McClennen & Fish

[57] ABSTRACT

A game ball of the type having a flexible resilient wall defining a space inside the ball that is fluid tight and contains a compressible fluid is given a break signalling capability by placing a small quantity of very fine particulate material in that space inside the ball.

4 Claims, 1 Drawing Sheet

GAME BALL

BACKGROUND OF THE INVENTION

This invention relates to ball break detection. It relates more particularly to apparatus for detecting the occurrence of a break in a hollow play ball when the ball is in play.

Certain racquet sports such as squash and tennis utilize a game ball having a flexible elastic wall defining a hollow interior which is filled with a compressible gas such as air to give the ball considerable resilience. When, during play, the ball is struck by a racquet or the ball strikes a hard surface, the wall of the ball is deflected inwardly thereby compressing the gas inside the ball so that the internal pressure rises dramatically. This increase in pressure gives the ball considerable potential energy so that the ball rebounds with appreciable velocity.

During the course of a game such sudden impacts can stress the ball to the extent that a break in the form of a hole, split or crack may develop in the wall of the ball. Accordingly when the ball next impacts the racquet or playing surface, the compression of the ball upon impact forces at least some of the fluid in the ball out through that opening thereby reducing the resilience of the ball to some extent. Resultantly, the next time the ball is hit by the racquet or next strikes the playing surface, it rebounds or behaves differently than it did prior to the break hereby making the ball harder to hit properly by the next player.

Oftentimes the damage to ball is progressive so that initially the crack or break in the wall of the ball is so small that it hardly affects the motion of the ball at all. However, at some point during the game, the break becomes sufficiently large as to change the overall resilience of the ball thereby giving the player who hit the ball last an unfair advantage over the other player or players. At some point, of course, the break becomes so noticeable to everyone that the ball is replaced. Before that point is reached, however, the ball may have been hit several times in its damaged condition giving an unfair advantage to one or another of the players, depending upon where the ball is struck by the racquet and where the ball is impacted by the playing surface.

SUMMARY OF THE INVENTION

Accordingly, it is an object of this invention to provide a hollow play ball with provision for indicating the presence of a break or hole in the wall of the ball.

Another object of the invention is to provide a ball which indicates the presence of a hole or crack in the wall of the ball only upon impact.

Still another object of the invention is to provide a ball of the above type which is not appreciably more expensive than conventional balls that do not have such detection capability.

A further object of the invention is to provide a break indicator for a ball which does not materially affect the motion or action of the ball during play.

Other objects will, in part, be obvious and will, in part, appear hereinafter.

The invention accordingly comprises of features of construction, combination of elements and arrangement of parts which will be exemplified in the following detailed description, and the scope of the invention will be indicated in the claims.

Briefly, a ball of the type incorporating my invention has an elastic or resilient wall that defines an interior space that must be fluid tight in order for the ball to be deemed suitable for play. Balls of this type include squash balls, tennis balls, hand balls etc. At the time of its manufacture, or subsequently, a small quantity of a very fine particulate material or powder, preferably having a bright distinctive color, is placed in the fluid tight space inside the ball.

So long as the wall of the ball is intact, the particulate material is confined inside the ball. However if even a very small split or break occurs in the wall of the ball, when the ball is next impacted by a racquet or a playing surface, the resultant compression of the ball increases the fluid pressure inside the ball sufficiently to force at least some of the particulate material out through the hole or break in the ball wall. The resultant puff of colored powder issuing from the ball signals the players that the ball is defective and should be replaced even though the break may not have become significant enough to materially affect the motion of the ball.

Only a small amount of light powdery material is needed to provide the requisite signal. Therefore this material does not add to the overall cost of the ball and its presence inside the ball does not affect in the least the ball motion or action during play. Also, since most of the game balls that have hollow interiors are made of rubber or rubber-like material, the ball is essentially self-sealing so that the signaling material inside the ball only escapes when there is a sudden rise of the internal pressure due to the compressive impacts on the ball. Therefore, the powder material does not discolor the game area to any appreciable extent.

BRIEF DESCRIPTION OF THE DRAWING

This invention is pointed out with particularity in the appended claims. The above and further advantages of this invention may be better understood by referring to the following description taken in conjunction with the accompanying drawing, in which:

DETAILED DESCRIPTION OF AN ILLUSTRATIVE EMBODIMENT

Figure 1:
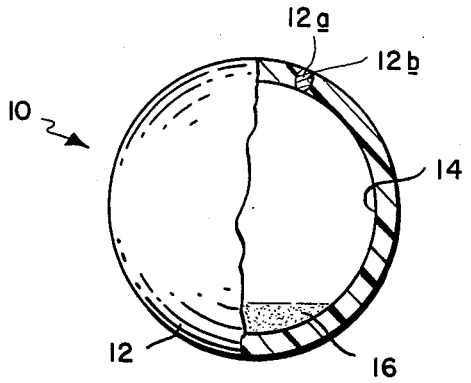
FIG. 1 is a front view with parts broken away showing a game ball incorporating my invention.

Referring to FIG. 1 of the drawing, a ball, e.g. a squash ball, incorporating my invention is shown generally at 10. The ball has a flexible resilient spherical wall 12 that defines an interior fluid-tight space 14 inside the ball. Normally, space 14 is filled with a compressible gas, such as air, under normal atmospheric pressure or at some higher pressure. Present also inside ball 10 is a small amount of a very fine particulate material 16 such as talc or Fuller's earth. Most preferably, the powdery material 16 is brightly colored so that it is quite visible.

The particulate material 16 may be introduced into ball 10 during the process of manufacturing the ball. Alternatively, it may be injected into the ball subsequent to the ball's manufacture using a device similar to the one described in U.S. Pat. No. 4,372,095. This device includes a very small diameter cannula leading from a source of pressurized gas and, in the present case, material 16. The cannula is inserted through the ball wall 12. As it penetrates the wall, the cannula cores out a tiny plug **12*a* which remains on the top of the cannula. The powder 16 is injected into the space 14 inside the ball via the cannula, following which the cannula is retracted from the ball. In the process, the cannula pulls the plug 12***a* back into the hole 12*b* left by the withdrawn cannula. The plug remains firmly in place due to the elasticity of the wall 12 material. Therefore, the coring of the wall 12 as aforesaid has substantially no adverse effect on the action of the ball during play.

Figure 2:
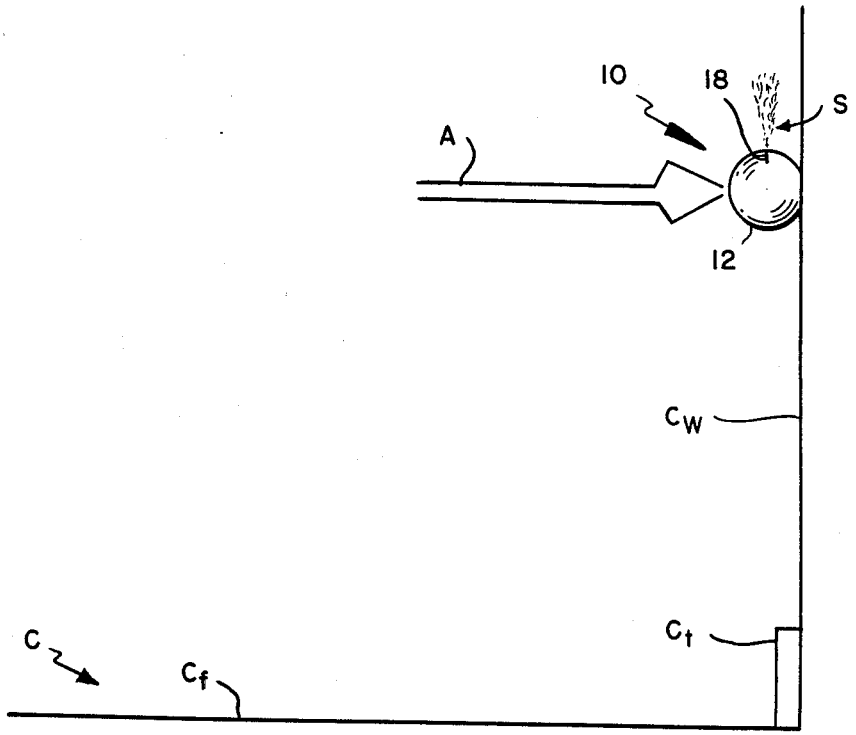
FIG. 2 is a diagrammatic view illustrating the operation of the FIG. 1 ball.

Refer now to FIG. 2, which shows diagrammatically a typical squash court C having a floor $C_f$ a front wall $C_w$ and a metal strip or "tin" $C_t$ extending across the front wall up to about 8 or 10 inches above floor level. When ball 10 is struck in the direction of arrow A it will eventually strike the front wall $C_w$ with considerably force. This impact deforms the ball wall 12 thereby reducing the volume of the space 14 inside the ball and compressing the gas therein to a very high pressure value. If there are no holes or breaks in the wall of the ball, the potential energy of the compressed gas and the natural resilience of wall 12 will cause the ball to rebound from wall $C_w$ with considerable kinetic energy.

However, if there should be even a very small hole or break 18 in ball 10 as it approaches wall $C_w$, the resultant sudden pressure buildup that occurs upon impact with that wall will force at least some of the colored powder particles 16 through the break on hole 18 so that they form a signaling puff S that is readily observable to the players on the court C. Therefore, the players will be apprised immediately that the ball is defective even though the break or hole 18 may not have become large enough at this point to adversely affect the motion or action of ball 10. Therefore the defective ball can be replaced before it has disadvantaged any player on the court.

Since only a very small amount of particulate material 16 is required in the ball 10 in order to give the ball such signaling capability, the inclusion of this feature adds very little to the overall cost of the ball. For the same reason, adding the signaling capability does not adversely affect the normal motion or action of the ball. Moreover, the particles 16 cannot escape from space 14 when the ball 10 is simply in motion due to the elastic self-sealing nature of ball wall 12. Therefore, contamination or marking of the game area by particles 16 is not a problem. Therefore, there is no reason not to provide such a hollow resilient game ball with a break signaling capability as herein described.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described.

What is claimed as new and desired to be secured by Letters Patent of the United States is:

1. A game ball comprising a flexible resilient imperforate wall defining a fluid-tight space inside the wall, a compressible fluid in said interior space and a small quantity of very fine particulate material in said interior space which cannot escape from said interior space until after there is a break in the wall of the ball that renders the ball defective.

2. The game ball defined in claim 1 wherein said particulate material is brightly colored.

3. The game ball defined in claim 1 wherein said particulate material comprises talc or Fuller's earth.

4. The game ball defined in claim 1 wherein said ball is a squash ball or a tennis ball.

* * * * *